United States Patent [19]

Feldman et al.

[11] Patent Number: 4,710,959

[45] Date of Patent: Dec. 1, 1987

[54] VOICE ENCODER AND SYNTHESIZER

[75] Inventors: Joel A. Feldman, North Cambridge; Edward M. Hofstetter, Carlisle, both of Mass.

[73] Assignee: Massachusetts Institute of Technology, Cambridge, Mass.

[21] Appl. No.: 572,786

[22] PCT Filed: Apr. 29, 1982

[86] PCT No.: PCT/US82/00556

§ 371 Date: Dec. 19, 1983

§ 102(e) Date: Dec. 19, 1983

[87] PCT Pub. No.: WO83/03917

PCT Pub. Date: Nov. 10, 1983

[51] Int. Cl.[4] ..... G10L 5/00

[52] U.S. Cl. ..... 381/36

[58] Field of Search ..... 381/36–41, 381/51–53

[56] References Cited

U.S. PATENT DOCUMENTS

| | | | |
|---|---|---|---|
| 3,624,302 | 11/1971 | Atal | 381/41 |
| 3,916,105 | 10/1975 | McCray | 381/41 |
| 4,038,495 | 7/1977 | White | 381/41 |
| 4,225,918 | 9/1980 | Beadle et al. | 364/200 |
| 4,301,329 | 11/1981 | Taguchi | 179/1.5 A |
| 4,304,965 | 12/1981 | Blanton et al. | 381/39 |
| 4,310,721 | 1/1982 | Manley et al. | 179/1.5 A |

OTHER PUBLICATIONS

Hofstetter et al., "Vocoder Implementations on the Lincoln Digital Voice Terminal", Proc. of Eascon 1975, Washington, D.C. (Sep. 1975).

Hofstetter et al., "Microprocessor Realization of a Linear Predictive Vocoder", Lincoln Laboratory Technical Note, 1976–37 (Sep. 1976).

Gold, B., "Note on Buzz-Hiss Detection", J. Acoust. Soc. Amer., 36, 1659–1661 (1964).

LeRoux et al., "A Fixed Point Computation of Partial Correlation Coefficients in Linear Prediction", 1977 IEE International Conf. on Acous., Speech and Signal Processing Rec., Hartford, Conn., May 9–11, 1977, pp. 742–743.

Arlington, US, G. C. O'Leary et al, "A Modular Approach to Packet Voice Terminal Hardware Design."

*Journal of the Acoustical Society of America,* vol. 57, Supplement No. 1, 1975, New York, US, R. Viswanathan et al, "Optimal Linear Interpolation in Linear Predictive Vocoders."

*IEEE Transactions on Audio and Electroacoustics,* "On Autocorrelation Equations as Applied to Speech Analysis," Markel & Gray, vol. Au-21, No. 2, Apr. 1973.

*IEEE Transactions on Acoustics, Speech, and Signal Processing,* "Average Magnitude Difference Function Pitch Extractor," Rose et al, vol. ASSP-22, pp. 353–362, Oct. 1974.

Compcon 79, Proceedings of the 19th *IEEE Computer Society International Conference,* 4th–7th Sep. 1979, Washington, D.C., pp. 203–206, IEEE, New York, US, A. J. Goldberg et al, "Microprocessor Implementation of a Linear Predictive Coder."

Tandon, V. B., "Tired of Just Reading Results? . . . ", Electronic Design, 24 (Nov. 22, 1978), pp. 160–163.

Gribble, D. R., "Single-Board Speech Synthesizer", 6 (Mar. 15, 1980), pp. 251–255.

Malpass, M. L., "The Gold Pitch Detector in a Real Time Environment", Proc. of Eascon, 1975 (Sep. 1975).

Gold, B., "Description of a Computer Program for Pitch Detection", Fourth International Congress on Acoustics, Copenhagen, Aug. 21–28, 1962.

*Wescon Technical Paper,* vol. 26, Sep. 1982, paper 34/4, pp. 1–5, Western Perisdicals Co., North Hollywood, US, W. Bauer, "The NEC muPD7720/SPI and an Applications Development in Speech Digitilization."

*Proceedings of the IEEE,* "Linear Prediction, A Tutorial Review," Makhoul, vol. 63, No. 4, Apr. 1975.

*Primary Examiner*—E. S. Matt Kemeny

*Attorney, Agent, or Firm*—James E. Maslow; Thomas J. Engellenner

[57] ABSTRACT

A very small, very flexible, high-quality, linear predictive vocoder has been implemented with commercially available integrated circuits. This fully digital realization is based on a distributed signal processing architecture employing three commercial Signal Processing Interface (SPI) single chip microcomputers. One SPI implements a linear predictive speech analyzer, a second implements a pitch analyzer while the third implements the excitation generator and synthesizer.

8 Claims, 2 Drawing Figures

VOICE ENCODER AND SYNTHESIZER

BACKGROUND OF THE INVENTION

The U.S. Government has rights to this invention pursuant to Contract AF19(628)-76-C-0002 awarded by the U.S. Air Force.

TECHNICAL FIELD

This invention relates to speech technology and, in particular, digital encoding techniques and methods for synthesizing speech.

Attention is directed to an article by one of the inventors herein, E. M. Hofstetter, and P. E. Blankenship et al., entitled "Vocoder Implementations on the Lincoln Digital Voice Terminal" *Proc. of EASCON* 1975, Washington, D. C. (Sept. 1975), in which various methods of compressing speech bandwidth are described. Attention is also directed to an article by Hofstetter et al. entitled "Microprocessor Realization of a Linear Predictive Vocoder" *Lincoln Laboratory Technical Note* 1976-37 (Sept. 1976), in which a dedicated microprocessor for linear predictive coding of speech is described. Both of these articles are incorporated herein by reference.

The principal method of transmitting speech electronically up until the present has been via an analog signal proportional to speech pressure on a transducer such as a microphone. Although electronic devices for bandwidth compression have been known since 1939 and many algorithms for digitally encoding speech have been proposed since the 1960's only with the expotentially decreasing cost of digital electronic technologies of the past fifteen years has a low-cost, low-power, compact, reliable vocoder implementation been foreseeable.

Of the various methods for encoding speech, one preferred method is linear predictive coding (LPC). For a seminal description of this technique see J. D. Markel, A. H. Gray, Jr. *Linear Prediction of Speech* (Springer-Verlag, N.T. 1967). Essentially, LPC seeks to model the vocal tract as a time varying linear all-pole filter by using very short, weighted segments of speech to form autocorrelation coefficients. From the coefficients, the critical frequency poles of the filter are estimated using recursion analysis.

In addition to modeling the vocal tract as a filter, a voice encoder must also determine the pitch period and voicing state of the vocal cords. One method of doing this is the Gold Method, described by M. L. Malpass in an article entitled "The Gold Pitch Detector in a Real Time Environment" *Proc. of EASCON* 1975 (Sept. 1975), also incorporated herein by reference. See also, generally B. Gold, "Description of a Computer Program for Pitch Detection", *Fourth International Congress on Acoustics,* Copenhagen, Aug. 21–28, 1962 and B. Gold, "Note on Buzz-Hiss Detection", J. Acoust. Soc. Amer. 36, 1659–1661 (1964).

For communication processing purposes, the encoding techniques described above must also be performed in the opposite direction in order to synthesize speech.

There exists a need for voice encoders and synthesizers (hereinafter "vocoders") in many communication and related areas. Bandwidth compression is one obvious advantage. Digital speech signals can also be coupled to encryption devices to insure private, secure communications of government defense, industrial and financial data. Moreover, data entry by vocal systems, private or not, represents a significant improvement over key punching in many applications. Additionally, voice authentication and vocal control of automated processes will also depend upon high quality vocoders. Likewise, vocoders may find significant use in entertainment, educational, and business applications.

Thus, there exists a need for high quality vocoders, preferably vocoders which are low cost and manufacturable from stock electronic components, such as standard signal processing chips.

SUMMARY OF THE INVENTION

We have developed a very compact, flexible, fully digital, full duplex 2.4 kilobit per second, linear predictive coding vocoder using only commercially available devices. A total of 16 integrated circuits and 4 discrete component carriers are used occupying 18 square inches and dissipating 5.5 watts of power. In one preferred embodiment, the design is a distributed signal processing architecture based on three Nippon Electric Company Signal Processing Interface (SPI) μPD7720 16-bit, 250 ns cycle time signal processing single-chip microcomputers and an Intel 8085 8-bit microcomputer for control and communications tasks.

Extreme flexibility is achieved by exploiting the microprogrammed nature of the design. Initialization options are downloaded from the Intel 8085 to the three SPI chips at run-time to choose linear predictive model order (less than 16), analysis and synthesis frame size, speech sampling frequency, speech input and output coding formats (linear or μ-255 law) as well as parameters to improve vocoder performance for a given input speech background noise condition. Finally, while commercial narrowband vocoder retail costs commonly exceed $10,000, it is projected that production quantities of the vocoder described here should be an order of magnitude less expensive.

Our invention will be described in connection with the preferred embodiment shown in the figures; however, it should be evident that various changes and modifications can be made by those skilled in the art without departing from the spirit and scope of the claims.

DETAILED DESCRIPTION OF PREFERRED EMBODIMENT

Figure 1:
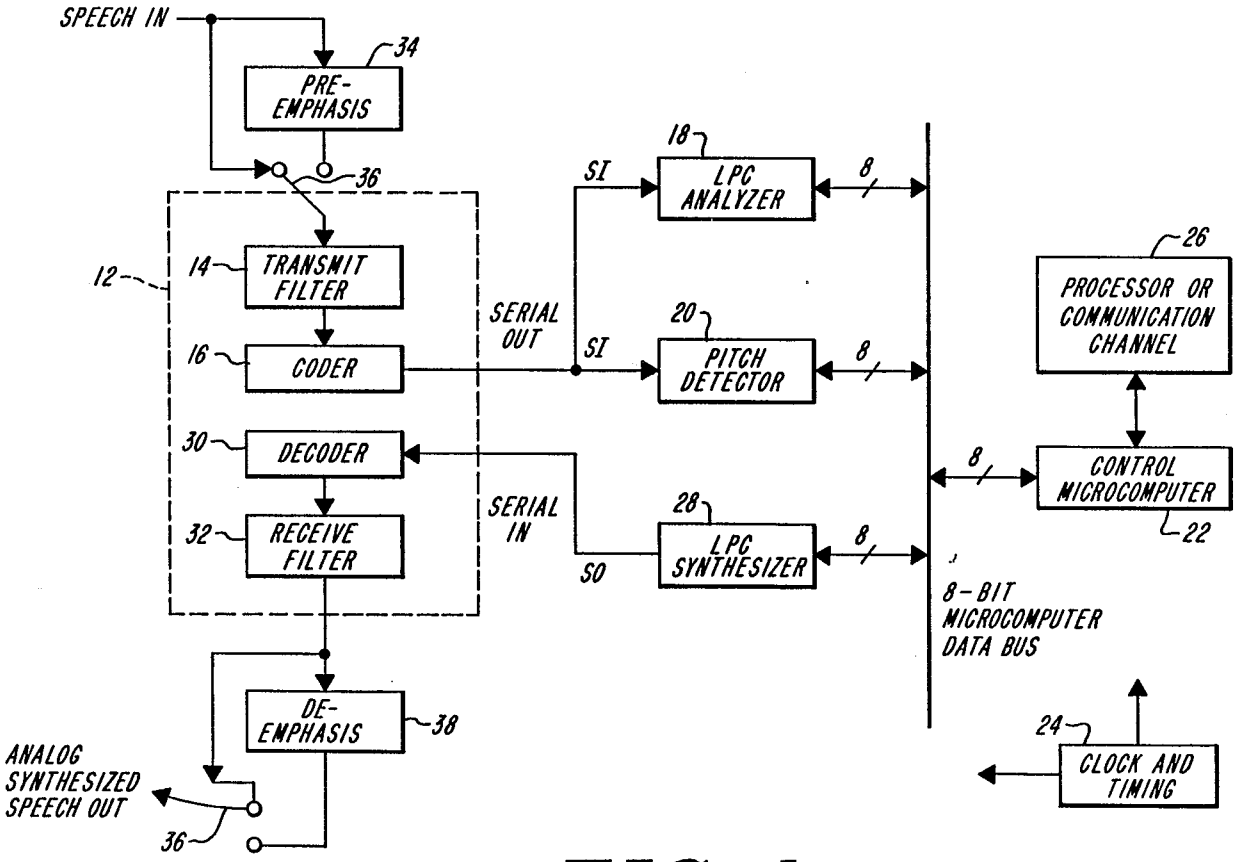
FIG. 1 is a schematic diagram of our vocoder.

In FIG. 1 the overall structure of vocoder 10 is shown. Analog signals are processed through a coder-decoder ("codec") module 12. Input signals passed through filter 14 and are converted to digital pulse trains in coder 16 within module 12. The output of coder 16 is a serial data stream for input to the LPC analyzer 18 and the pitch detector 20.

In each analysis frame, the resulting linear predictive reflection coefficients (K-parameters), energy and pitch estimates are transferred to a terminal processor 26 or the outside world over an 8-bit parallel interface under the control of a four-chip Intel 8085-based microcomputer 22. In a similar fashion, the control computer 22 receives synthesis parameters each frame from the outside world or terminal processor 26 and transmits them to the SPI synthesizer chip 28 which constructs and outputs the synthetic speech through its serial output port to the digital-to-analog conversion module 12 which includes the decoder 30 and output filter 32. The 8-bit bus is also used by the controller 22 to download initialization parameters to the three SPI chips as well as to support SPI chip frame synchronization during normal operation. Timing signals for the entire vocoder are provided by timing subsystem 24. The module 12 may be based on the AMI S3505 single chip CODEC-with-filters and includes switches 36 for choice of analog or digitally implemented pre-emphasis unit 34 and de-emphasis unit 38.

Figure 2:
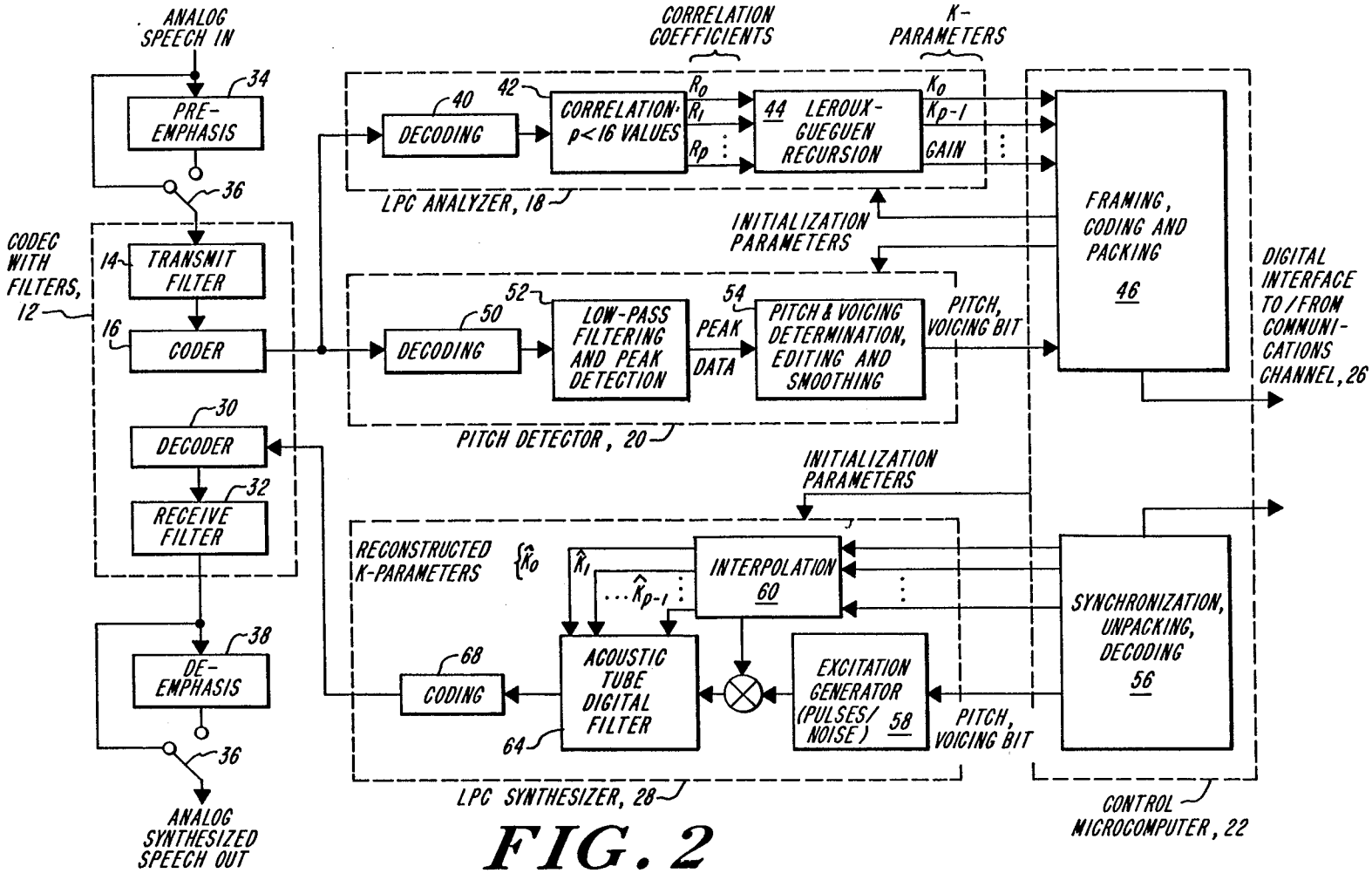
FIG. 2 is a detailed schematic diagram of the LPC analyzer, pitch detector and synthesizer of our vocoder.

As shown in FIG. 2, the LPC analyzer 18 functions as follows: Initialization parameters are received from controller 26 which set sampling rate-related, correlation and filter order constants. Digital signals from the codec unit 12 are first decoded for linear processing by decoder 40, then correlation coefficients are established by correlator 42 and analyzed by recursion analyzer 44 to obtain the K parameters defining the poles of the filter model.

The pitch detector 20 also receives initialization parameters from the controller 22 and receives the digital signals from the codec unit 12. The digital signals are decoded for linear processing by decoder 50 and processed by peak detector 52 and then pitch and voicing determinations are made in unit 54 implementing the Gold algorithm.

The outputs of the LPC analyzer 18 and the pitch detector 20 are framed, recoded and packed for transmission on a communication channel 26 by controller 22.

In synthesizing speech the synthesizer 28 receives signals from the communications channel 26 after they have been synchronized, unpacked and decoded by controller 22. The synthesizer 28 also receives initialization parameters from the controller 22. Pitch and voicing instructions are sent to the excitation generator 58 and the K-parameters are reconstructed by interpolator 60. The results are combined by filter 64 to produce the proper acoustic tube model. The output of filter 64 is coded in the non-linear format of codec module 12 by coder 68 and sent to the codec unit 12 for analog conversion.

The operations of the-LPC analyzer 18, the pitch detector 20 the synthesizer 28 and the codec unit 12 are further described below in narrative form. Since this description makes various references to the NEC chip architecture, attention is further directed to a document published by NEC entitled "μPD7720 Signal Processing Interface (SPI) User's Manual", incorporated herein by reference.

LPC ANALYZER

The LPC analyzer 18 consists of an interrupt service routine which is entered each time a new sample is generated by the A/D converter 12 and a background program which is executed once each analysis frame (i.e. approximately 20 ms) on command from the control microcomputer. The parameters for the analysis are transferred from the control processor 22 to '7720 by means of an initialization program that is executed once during the start-up phase of operation. The parameters required for analysis are two Hamming window constants S and C to be defined later, the filter order p (less than 16), a constant that determines the degree of digital preemphasis to be employed and a precorrelation downscaling factor. The final parameter sent is a word containing two mode-bits one of which tells the '7720 the type of A/D converter data format to expect, 8-bit μ-255 coded or 16-bit linear. The other bit determines which LPC energy parameter, residual or raw, will be transmitted to the control processor 22 at the conclusion of each frame. The remaining analysis parameters sent to the control processor 22 are the p reflection coefficients.

The A/D interrupt service routine first checks the mode bits to determine whether the input datum is 8-bit mu-coded or 16-bit uncoded. The datum is decoded if necessary and then passed to the Hamming window routine. This routine multiplies the speech datum by the appropriate Hamming weight. These weights are computed recursively using the stored constants S and C which denote the sine and cosine, respectively, of the quantity $2\pi/N-1$ where N is the number of sample points in an analysis frame.

The windowed speech datum is now multiplied by the stored precorrelation downscaling factor and passed to the autocorrelation routine. The value of the downscaling factor depends on the frame length and must be chosen to avoid correlator overflow. The correlation routine uses the windowed, scaled speech datum to recursively update the $p+1$ correlation coefficients being calculated for the current frame. The full 32-bit product is used in this calculation. This computation concludes the tasks of the interrupt service routine.

The background routine computes the LPC reflection coefficients and residual energy from the correlation coefficients passed to it by the interrupt service routine. This computation is performed once per frame on command from the control microcomputer 22. Upon receiving this command, the background routine leaves an idle loop and proceeds to use the aggregate processing time left over from the interrupt service routine to calculate the LPC parameters. The first step in this process is to take the latest $p+1$ 32-bit correlation coefficients and put them in 16-bit, block-floating-point format. The resulting scaled correlation coefficients are then passed to a routine implementing the LeRoux-Gueguen algorithm. See, generally, J. LeRoux and C. Gueguen, "A Fixed Point Computation of Partial Correlation Coefficients in Linear Prediction," 1977 *IEEE International Conf. on Acous., Speech and Signal Processing Rec.*, Hartford, Conn., May 9–11, 1977, pp. 742–743. The end result of this computation is an array consisting of p reflection coefficients and the prediction residual energy. The energy is now corrected for the block-floating-point operation performed earlier. This set of parameters with the residual energy replaced by the raw energy (zeroth correlation coefficient) if so dictated by the appropriate mode bit is shipped to the control microcomputer. Parameter coding is implemented in the control processor 22 in order to maintain the flexibility of the SPI analyzer.

Two aspects of the analyzer's performance can be monitored by means of the SPI hardware pins Pϕ and P1. Pin Pϕ is set to a one during each frame the correlator overflows; it is cleared otherwise. Pin Pϕ therefore is useful in choosing the correlator downscaling factor which is used to limit correlator overflows. Real-time usage can be monitored from pin P1 which is set to one during the interrupt service routine and set to zero otherwise.

PITCH DETECTOR

In each analysis frame the pitch detector 20 declares the input speech to be voiced or unvoiced, and in the former case, computes an estimate of the pitch period in units of the sampling epoch. The Gold algorithm is used here and is implemented with a single N.E.C. μPD7720. The foreground routine is comprised of computations which are executed each sample and additional tasks executed when a peak is detected in the filtered input speech waveform. Although in the worst case the pitch detector foreground program execution time can actually overrun one sampling interval, the SPI's serial input port buffering capability relaxes the real-time constraint by allowing the processing load to be averaged over subsequent sampling intervals. The foreground routine is activated by the sampling clock 24. When a new sample arrives before processing of the previous sample is complete (detected by checking the '7720 serial input acknowledge flip-flop), the foreground routine is immediately repeated without returning to the background task. The initialization parameters downloaded to the pitch detector chip 20 allow operation at an arbitrary sampling frequency within the real-time constraint. They include the coefficients and gains for a third-order Butterworth low-pass prefilter and internal clamps for maximum and minimum allowable pitch estimates. A voicing decision silence threshold is also downloaded to optimize pitch detector performance for differing combination of input speech background noise conditions and audio system sensitivity. The real-time usage of the SPI pitch detector 20 for a given set of initialization parameters can be readily monitored through the SPI device's two output pins. The Pϕ outpin pin is set to a high TTL level when the background routine is active and the P1 pin is set high when the foreground routine is active. The real-time constraint for the pitch detector is largely determined by the nominal foreground processing time since the less frequently occurring, worst case processing loads are averaged over subsequent sampling intervals.

SYNTHESIZER

In each frame the SPI synthesizer 28 receives an energy estimate, pitch/voicing decision and a set of reflection coefficients from the control and communications microprocessor 22, constructs the synthesized speech, and outputs it through the SPI serial output port. The synthesizer 28 consists of a dual-source excitation generator, a lattice filter and a one-pole digital de-emphasis filter. The lattice filter coefficients are obtained from a linear interpolation of the past and present frames' reflection coefficients. In voiced frames, the filter excitation is a pulse train with a period equal to the pitch estimate and amplitude based on a linear interpolation of the past and present frames' energy estimates while in unvoiced frames a pseudo-random noise waveform is used. In each sampling interval the SPI interrupt-driven foreground routine updates the excitation generator and lattice and de-emphasis filters to produce a synthesized speech sample. The foreground routine also interpolates the reflection coefficients three times a frame and interpolates the pitch pulse amplitudes each pitch period. In sampling intervals where interpolation occurs and at frame boundaries where new reflection coefficients are obtained from the background routine, foreground execution time can overrun one sampling interval. As in the pitch detector 20, a foreground processing load averaging strategy is used to maintain real-time. The background program is activated when the foreground program receives a frame mark from the control microprocessor at which time it inputs and double buffers a set of synthesis parameters under a full-handshake protocol. Parameter decoding is executed in the control processor to maintain the universality of the SPI synthesizer. The background routine also converts the energy estimate parameter to pitch pulse amplitudes during voiced frames and pseudo-random noise amplitudes during unvoiced frames. These amplitudes are based on the energy estimate, pitch period and frame size.

A highly programmable synthesizer configuration is achieved in this implementation by downloading at vocoder initialization time the lattice filter order, synthesis frame size and interpolation frequency from the controller 22. Other programmable features include choice of 16-bit linear or 8-bit μ-255 law synthetic speech output format and choice of feedback and gain coefficients for the one-pole de-emphasis filter. Digital de-emphasis may be effectively by-passed by setting the feedback coefficient to zero. Finally, the energy estimate can be interpreted as either the residual energy or as the zeroth autocorrelation coefficient. As in the SPI pitch detector, hardware pins Pϕ and P1 monitor real-time usage by denoting the background and foreground programs activity. The synthesizer's real-time constraint is determined by its nominal foreground processing load since the worst case processing load occurs only at frame and interpolation boundaries and is averaged over subsequent sampling intervals.

CONTROL MICROCOMPUTER

Each analysis frame, the control microcomputer 22 received from the analyzer 18 and pitch detector 20 SPI's the energy estimate, p reflection coefficients, pitch estimate and voicing decision and transmits them to the communication channel. In a similar fashion, the control microcomputer 22 receives from the communications channel 26 each frame these parameters and sends them to the synthesizer 28. Coding and packing of the analyzer and pitch detector parameters and decoding and unpacking of the synthesis parameters is done in the control microcomputer to maintain the flexibility of the three SPI devices. Frame synchronization for both analysis and synthesis is also the responsibility of the control microcomputer 22 and may be obtained from either the timing subsystem 24 or from the communication channel 26 itself. Finally, the control microcomputer 22 includes a start-up routine which initializes the SPI's with constants determining the sampling rate, frame size, linear predictive model order and speech inputs and outputs coding formats. The control microcomputer 22 is based on the Intel 8085 A-2 8-bit microprocessor.

ANALOG/DIGITAL CONVERSION SUBSYSTEM

A very compact analog subsystem is achieved in this design with the use of the AMI S3505 CODEC-with-filters which implements switched capacitor input and output band limiting filters and 8-bit μ-255 law encoder (A/D converter) and decoder (D/A converter) in a 24-pin DIP. The CODEC's analog input is preceded by a one-zero (500 Hz), one-pole (6 kHz) pre-emphasis filter. The analog output of the S3505 is followed by the corresponding one-pole (500 Hz) de-emphasis filter. The analog pre- and de-emphasis may be switched out when the SPI chip internal digital pre- and de-emphasis are used. The analog subsystem in total requires one 24-pin AMI S3505 CODEC, one 14-pin quad op-amp DIP and two 14-pin discrete component carriers.

I claim:

1. In a signal processing digital voice encoding device including sampling means for sampling analog voice signals and producing discrete samples from a frame of said voice signals, the improvement comprising:

A first signal processing microprocessor in circuit with said sampling means and including foreground and background analyzing means for analyzing said samples by which said voice is modeled as a time-varying, linear, all-pole filter and a set of linear predictive reflection coefficients, which define the poles of said linear filter, are established by recursively filtering said samples from said sampling means, the foreground analyzing means multiplying, once each sample, speech datum in each sample by an appropriate Hamming weight which is recursively computed to obtain a set of correlation coefficients, and the background analyzing means computing from said correlation coefficients a set of linear predictice reflection coefficients and an energy estimate of said voice signal once each analysis frame;

a second signal processing microprocessor in circuit with said sampling means and including pitch detector means for making a voicing decision and, when the sample includes voiced speech, determining the pitch of the voice from the samples of the sampling means, said pitch detector means comprising a low pass filter, a peak detector, a pitch and voicing estimator and means for smoothing output signals; and Controller microprocessor means in circuit with said first and second signal processing microprocessors for arranging the outputs of the analyzing means and the pitch detector means in a format suitable for digital transmission and for initializing said first and second processing elements with constants determining a sampling rate, an analysis frame size, and a linear predictive model order, wherein said first and second signal processing microprocessors and said controller microprocessor means form a parallel, distributed, signal processing circuit.

2. In the encoding device of claim 1, the further improvement wherein the sampling means produces samples in a non-linear, coded format.

3. In the encoding device of claim 1 the further improvement wherein the sampling means further comprises means to pre-emphasize portions of the analog voice signals.

4. In the encoding device of claim 1 the further improvement wherein the analyzing means employs a linear predictive code having a filter order of less than sixteen linear predictive reflective coefficients.

5. In the encoding device of claim 1 the further improvement wherein the controller microprocessor further comprises means for framing, packing and coding the digital outputs prior to transmission.

6. In the device of claim 1, the further improvement comprising:

a. Means for receiving digital signals providing voicing, pitch and filter-model information;

b. An excitation generator for producing vocal cord excitation signals in response to voicing and pitch commands from the controller;

c. A variable digital filter for filtering the output of the generator in response to commands from the controller; and d. A converter for converting the output of the digital filter into analog voice signals.

7. In the synthesizing device of claim 6 the further improvement wherein the variable digital filter further comprises interpolation means for interpolating successive energy and K-parameter inputs from the controller to produce higher quality output signals to the converter.

8. In the synthesizing device of claim 6 the further improvement wherein the receiving means further comprises means for decoding, unpacking and synchronizing the digital input signals.

* * * * *